US009835097B1

(12) United States Patent
Schrewe et al.

(10) Patent No.: US 9,835,097 B1
(45) Date of Patent: Dec. 5, 2017

(54) APPARATUS AND METHODS FOR PERFORMING VARIABLE DISPLACEMENT CONTROL FOR A VEHICLE ENGINE

(71) Applicant: Honda Motor Co., Ltd., Tokyo (JP)

(72) Inventors: Mark R. Schrewe, Dublin, OH (US); Adam H. Vosz, Delaware, OH (US); Paul K. Dehart, Urbana, OH (US); Courtney L. Forsythe, West Mansfield, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 22 days.

(21) Appl. No.: 15/230,234

(22) Filed: Aug. 5, 2016

(51) Int. Cl.

| | |
|---|---|
| ***F02D 17/02*** | (2006.01) |
| ***F02D 41/26*** | (2006.01) |
| ***F02D 41/00*** | (2006.01) |
| ***F02D 41/30*** | (2006.01) |
| ***F02D 41/02*** | (2006.01) |

(52) U.S. Cl.
CPC ..... *F02D 17/02* (2013.01); *F02D 41/0002* (2013.01); *F02D 41/008* (2013.01); *F02D 41/0225* (2013.01); *F02D 41/26* (2013.01); *F02D 41/3005* (2013.01); *F02D 2200/101* (2013.01); *F02D 2200/1002* (2013.01)

(58) Field of Classification Search
CPC .. F02D 17/02; F02D 41/0225; F02D 41/0002; F02D 41/008; F02D 41/26; F02D 41/3005; F02D 41/0087; F02D 41/1497; F02D 11/105; F02D 11/106; F02D 2041/0012; F02D 2200/101; F02D 2200/1002; F02D 2250/18
USPC ..... 123/436, 481, 90.15, 198 F; 701/103, 701/110
See application file for complete search history.

(56) References Cited

U.S. PATENT DOCUMENTS

| | | | |
|---|---|---|---|
| 4,104,991 | A | 8/1978 | Abdoo et al. |
| 5,408,974 | A | 4/1995 | Lipinski et al. |
| 5,884,603 | A | 3/1999 | Matsuki |
| 5,970,943 | A | 10/1999 | Robichaux et al. |
| 6,615,804 | B2 | 9/2003 | Matthews et al. |
| 6,748,916 | B2 | 6/2004 | Schaefer-Siebert |

(Continued)

OTHER PUBLICATIONS

Kortwittenborg et al. "Strategy to Control the Cylinder Deactivation" Bosch Development Engine Management. MTZ 0212013 vol. 74, pp. 18-22.

*Primary Examiner* — Hai Huynh
(74) *Attorney, Agent, or Firm* — Kenealy Vaidya LLP

(57) ABSTRACT

A variable displacement controller for deactivating one or more cylinder assemblies of a vehicle engine can include a processor for performing various operations and the operations can include: receiving data indicative of a requested torque and vehicle speed, determining a torque variable timer threshold value based on the received data indicative of requested torque and vehicle speed, initiating a timer, comparing the timer value to the variable timer threshold value, and selectively activating/deactivating at least one of the engine cylinder assemblies based on the comparison between the timer value and the variable timer threshold value. At least one of the engine cylinder assemblies is activated if the timer value is less than the variable timer threshold value, and at least one of the engine cylinder assemblies is deactivated if the timer value is greater than or equal to the variable timer threshold value.

20 Claims, 8 Drawing Sheets

(56) References Cited

U.S. PATENT DOCUMENTS

| | | | | |
|---|---|---|---|---|
| 6,752,121 | B2 | 6/2004 | Rayl et al. | |
| 6,857,491 | B2 | 2/2005 | Wakashiro et al. | |
| 7,021,273 | B1 | 4/2006 | Prucka et al. | |
| 7,044,885 | B2 | 5/2006 | Doering | |
| 7,328,686 | B2 | 2/2008 | Cullen | |
| 7,350,499 | B2 | 4/2008 | Takaoka et al. | |
| 7,647,154 | B2 | 1/2010 | Heap | |
| 7,757,666 | B2 | 7/2010 | Whitney et al. | |
| 7,765,052 | B2 | 7/2010 | Kaiser et al. | |
| 7,775,320 | B2 | 8/2010 | McCain et al. | |
| 7,913,669 | B2 | 3/2011 | Luken et al. | |
| 8,550,055 | B2 | 10/2013 | Ferch et al. | |
| 8,886,422 | B2 | 11/2014 | Sujan et al. | |
| 8,967,118 | B2 | 3/2015 | Whitney et al. | |
| 9,598,065 | B2 * | 3/2017 | Mori | B60W 10/06 |
| 2004/0237935 | A1 | 12/2004 | Fukusako et al. | |
| 2010/0147258 | A1 | 6/2010 | Edwards et al. | |
| 2013/0327292 | A1 | 2/2013 | Knippelmeyer | |

* cited by examiner

APPARATUS AND METHODS FOR PERFORMING VARIABLE DISPLACEMENT CONTROL FOR A VEHICLE ENGINE

BACKGROUND

The disclosed subject matter relates to methods and apparatus for controlling a variable-displacement, multiple-cylinder, internal combustion engine. More particularly, the disclosed subject matter relates to varying the displacement by selectively deactivating combustion in one or more cylinders of the engine.

Some related art internal combustion engines can include a relatively large number of combustion cylinder assemblies in order to achieve one or more desirable performance targets, such as but not limited to high travel speed, low acceleration times, high torque output at low speeds, etc. Generally, fuel efficiency of an engine with a larger number of combustion cylinders can be less than that for an engine having a smaller number of combustion cylinders. Additionally, the total torque output by the engine can exceed the amount necessary under certain operating conditions, such as idling, low speed travel, heavy traffic, steady speed cruising, etc. This excess torque can be converted to heat that is exhausted to the ambient environment, thus further reducing the fuel efficiency of the engine.

SUMMARY

Some embodiments are therefore directed to a variable displacement controller for use with a vehicle engine that includes multiple cylinder assemblies. According to one aspect, the controller can include a processor for performing various operations that can include: receiving data indicative of a requested torque, receiving data indicative of vehicle speed, determining a torque variable timer threshold value based on the received data indicative of requested torque and vehicle speed, initiating a timer, comparing the timer value to the determined variable timer threshold value, and selectively activating/deactivating at least one of the engine cylinder assemblies based on the comparison between the timer value and the variable timer threshold value, such that the at least one of the engine cylinder assemblies is activated if the timer value is less than the variable timer threshold value, and the at least one of the engine cylinder assemblies is deactivated if the timer value is greater than or equal to the variable timer threshold value.

In another aspect, a variable displacement system can include a vehicle engine including multiple cylinder assemblies, a speed sensor that can obtain data indicative of at least one of engine speed and vehicle speed, and a variable displacement controller. The controller can include a processor for performing at least the operations of receiving data indicative of a requested torque, receiving data indicative of vehicle speed, determining a torque variable timer threshold value based on the received data indicative of requested torque and vehicle speed, initiating a timer, comparing the timer value to the determined variable timer threshold value, and selectively activating/deactivating at least one of the engine cylinder assemblies based on the comparison between the timer value and the variable timer threshold value, such that at least one of the engine cylinder assemblies is activated if the timer value is less than the variable timer threshold value, and at least one of the engine cylinder assemblies is deactivated if the timer value is greater than or equal to the variable timer threshold value.

In yet another aspect, a method of performing variable displacement of a vehicle engine that includes multiple cylinder assemblies can include receiving data indicative of a requested torque; receiving data indicative of vehicle speed, determining a torque variable timer threshold value based on the received data indicative of requested torque and vehicle speed; initiating a timer, comparing the timer value to the determined variable timer threshold value; and selectively activating/deactivating at least one of the engine cylinder assemblies based on the comparison between the timer value and the variable timer threshold value, such that at least one of the engine cylinder assemblies is activated if the timer value is less than the variable timer threshold value, and at least one of the engine cylinder assemblies is deactivated if the timer value is greater than or equal to the variable timer threshold value.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

Figure 1:
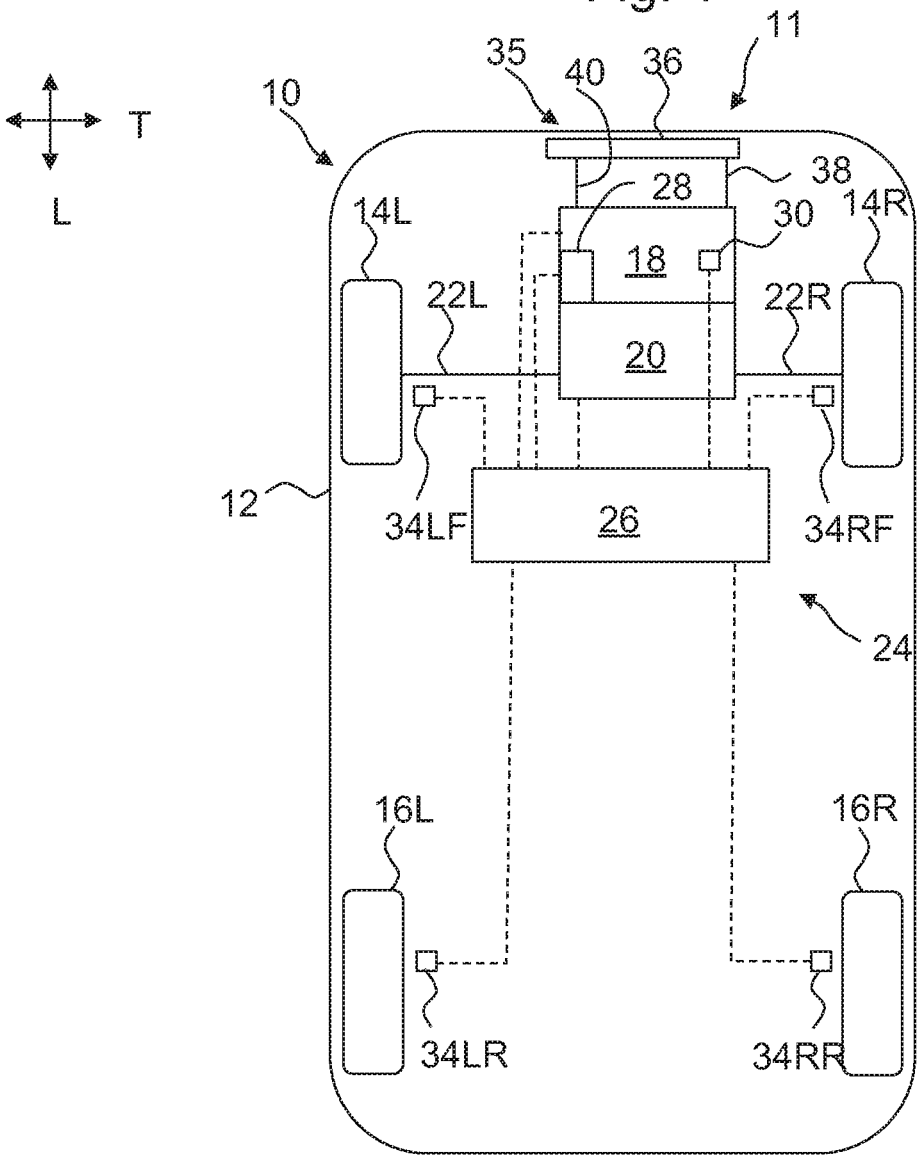
FIG. 1 is a schematic view of a powertrain for a vehicle in accordance with the disclosed subject matter.

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows.

In order to enhance or improve fuel efficiency under low load conditions, some multiple-cylinder engines can selectively deactivate combustion in one or more cylinders of the engine. For example, a six-cylinder engine can be operated in a four-cylinder mode or in a three-cylinder mode. Similarly, an eight-cylinder engine can be operated in one of at least a six-cylinder mode and a four-cylinder mode.

However, noise and/or vibration characteristics differ depending on the mode in which the engine is operating. For example, noise and/or vibration characteristics differ depending on whether a six-cylinder engine is operating in the six-cylinder mode, a four-cylinder mode, or a three-cylinder mode. In other words, the noise and/or vibration characteristics of each of these modes can be different than the other modes. These different noise and vibration characteristics can be transmitted into the passenger compartment of the vehicle where they can be perceived by the driver and one or more passenger(s) as undesirable.

Some methods and systems may selectively activate and deactivate one or more combustion cylinder assemblies, but fail to provide an advantageous amount of time that the system is active, while preventing excessive and/or frequent activation and deactivation operation ("hunting") during variable cylinder management (VCM). Excessive hunting can degrade the fuel economy impact as well as cause poor vehicle drivability. Unwanted VCM hunting can occur at higher speeds and/or road loads where an engine operation approaches the VCM operational torque limit. The negative issues of VCM hunting can be exacerbated by rough driving styles.

It may therefore be beneficial to provide a variable-displacement, multiple-cylinder, internal combustion engine that addresses at least one of the above and/or other disadvantages. In particular, it may be beneficial to provide methods and apparatus for selectively activating and deactivating one or more combustion cylinder assemblies based on variable cylinder management (VCM) hunting controls. For example, it may be beneficial to selectively activate and deactivate combustion in one or more cylinders based on vehicle speed and filtered data from driver requested torque to reduce VCM hunting effects due to driving style, environmental conditions, or vehicle road load including towing and grade. It may also be beneficial to provide a timer that can be used to vary a delay before initiating VCM based on a predicted relative risk of hunting effects to decrease transitions in and out of VCM. It may also be beneficial to enhance or improve fuel efficiency in a vehicle by performing predictive VCM hunting risk calculations and activate VCM when an enhancement or improvement to real-world fuel economy is probable.

I. Exemplary Vehicle and Engine Assemblies

FIG. 1 illustrates an embodiment of a vehicle 10 made in accordance with the principles of the disclosed subject matter. The vehicle 10 can include a powertrain 11, a body 12, a pair of front wheels 14L, 14R and a pair of rear wheels 16L, 16R. The powertrain 11 can be configured to drive at least one of the pair of front wheels 14L, 14R and the pair of rear wheels 16L, 16R. The body 12 can enclose a passenger compartment configured to accommodate at least one passenger.

The powertrain 11 can include an internal combustion engine 18, a transmission 20, a pair of driveshafts 22L, 22R, a control system 24, and an engine cooling system 35. As shown in FIG. 1, the engine cooling system can include a radiator 36, a radiator inlet line 38, and a radiator outlet line 40. The radiator 36 can be configured as an air-to-liquid heat exchanger. The radiator inlet line 38 can place the radiator 36 in fluid communication with hot engine coolant exiting the engine 18. The radiator outlet line 40 can place the engine 18 in fluid communication with engine coolant that has been cooled by the radiator 36.

The output axis of the engine 18 can be oriented in the longitudinal direction L or in the traverse direction T of the vehicle 10. The engine 18 can be mounted forward of the front axles, rearward of the rear axles, or intermediate the front and rear axles. The engine 18 can be connected to drive the front wheels 14L, 14R, or the rear wheels 16R, 16L, or both the front wheels 14L, 14R and the rear wheels 16L, 16R. In the exemplary embodiment of FIG. 1, the engine 18 is configured as a transversely-oriented front-mounted internal combustion engine driving the front wheels 14L, 14R.

The engine 18 can include a plurality of combustion cylinder assemblies of an even count or of an odd count. The cylinders can be arranged in "V" pattern or a "W" pattern, arranged in pair of horizontally opposed banks, arranged in a single row, or arranged in any other appropriate configuration.

The transmission 20 can be configured as an automatic transmission, a manual transmission, or a semi-automatic transmission. The transmission 20 can be configured in any appropriate manner with a stepped speed ratio assembly or a continuously variable speed ratio assembly. The transmission 20 can be coupled to the driveshafts 22L, 22R in any appropriate manner that can permit transmission drive torque from the engine to the front wheels.

A coupling can connect an engine output shaft to a transmission input shaft. The coupling can permit selective engagement/disengagement of the transmission input shaft with the engine output shaft, or at least permit relative rotation of the engine output shaft with respect to the transmission input shaft, in any appropriate manner. Exemplary couplings can include, but are not limited to, a friction disc clutch and a torque converter. The exemplary vehicle 10 of FIG. 1 can include a torque converter and a lock-up clutch that can selectively connect the input and output of the torque converter to rotate together.

In order to enhance or improve the fuel efficiency of the engine 18 during certain operating conditions, the control system 24 can be configured to selectively deactivate and activate at least one of the combustion cylinder assemblies. The control system 24 can include a controller 26 and a cylinder deactivation assembly 28. The controller 26 can be in electrical communication with the engine 18, the transmission 20, the cylinder deactivation assembly 28, an accelerator pedal sensor 30, a timer 32, and wheel speed sensors 34LF, 34RF, 34LR, 34RR in any appropriate manner. The control system 24 can share the sensors 30, 34LF, 34RF, 34LR, 34RR and the timer 32 with other system(s) of the vehicle 10. However, exemplary embodiments are intended to include the one or more of the timer 32 and the sensors 30, 34LF, 34RF, 34LR, 34RR as exclusive to the control system 24.

Figure 2:
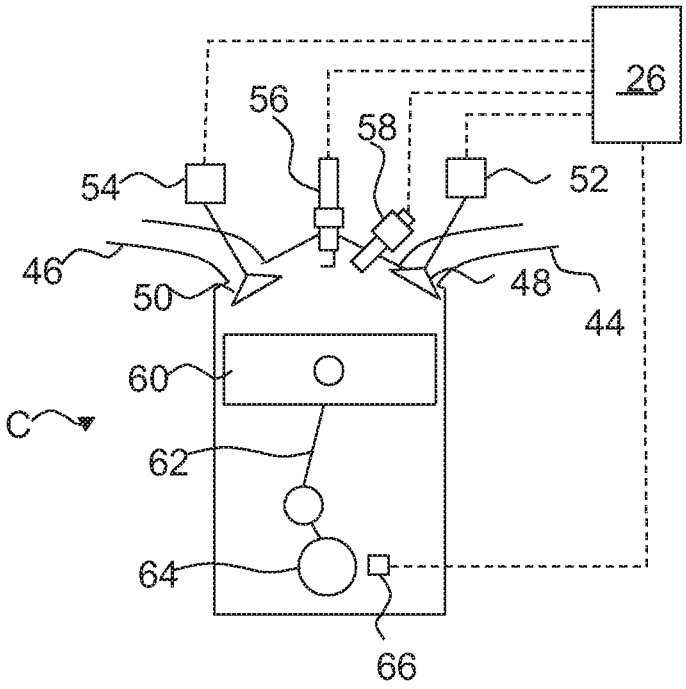
FIG. 2 is a schematic view of an exemplary combustion cylinder assembly of the engine of FIG. 1 and exemplary features of the variable displacement control system of FIG. 1.

FIG. 2 schematically illustrates exemplary features of the engine 18 and the cylinder deactivation assembly 28. The engine 18 can include a plurality of combustion cylinder assemblies arranged in the manner of exemplary combustion cylinder assembly C. The assembly C can include an intake port 44, exhaust port 46, intake valve 48, exhaust valve 50, intake actuator 52, exhaust actuator 54, spark plug 56, fuel injector 58, piston 60, connecting rod 62, and crankshaft 64. The intake actuator 52, exhaust actuator 54, spark plug 56, and fuel injector 58 can be features of the assembly C that can be shared with the cylinder deactivation assembly 28.

An engine speed sensor 66 can be configured to output data indicative of the rotational speed (Ne) of the crankshaft 64. This data can be expressed in revolutions per minute (RPM). The engine speed sensor 66 can be shared with other control systems of the engine 18, or the sensor 66 can be exclusive to the control system 24.

The controller 26 can be in electrical communication with the intake actuator 52, exhaust actuator 54, spark plug 56, fuel injector 58 and engine speed sensor 66. If the controller 26 determines that it can be advantageous to deactivate the combustion cylinder assembly C, the controller 26 can signal any appropriate one or combination of the intake actuator 52, exhaust actuator 54, spark plug 56 and fuel injector 58 to shut down. This shut down can prevent combustion of fuel within the assembly C, thereby increasing fuel efficiency of the engine 18 under certain operating conditions of the engine 18 and the vehicle 10.

Figure 3:
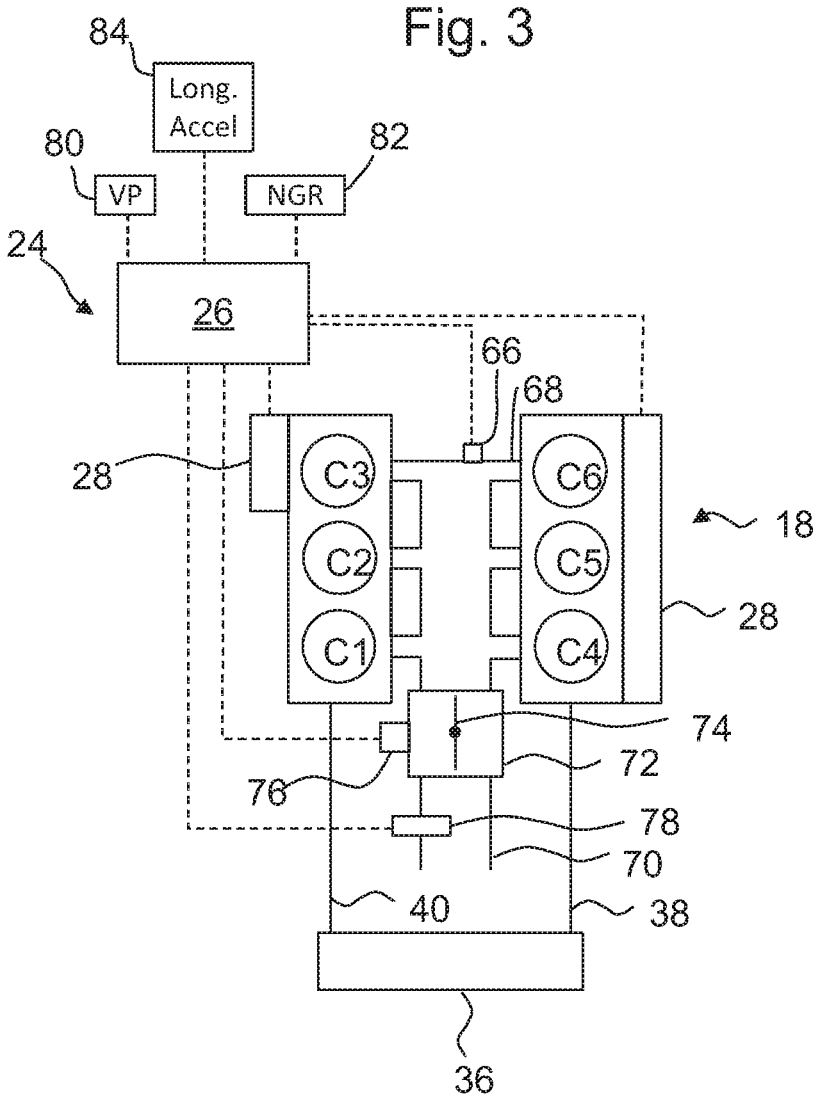
FIG. 3 is a schematic view of an internal combustion engine and a variable displacement control system in accordance with the disclosed subject matter.

The accelerator pedal sensor 30 can be configured to output data indicative of a position of the accelerator pedal, which can be used with engine speed data to develop a driver demand torque map (that is, the torque requested by the driver as a function of engine speed Ne and a position of the accelerator pedal of the vehicle 10). Embodiments are intended to include a throttle position sensor 76 instead if an accelerator pedal sensor 30. The throttle position sensor 76 can be configured to output data indicative a position of a throttle valve 74, as shown in FIG. 3. Each wheel speed sensor 34LF, 34RF, 34LR, 34RR can be configured to output data indicative of a rotational velocity of a respective one of the plurality of wheels. The timer 32 can be configured to output clock data. Embodiments are intended to include a timer 32 fully integrated with the controller 26, either through hardware, software or a combination of hardware and software.

FIG. 3 is a schematic view of an internal combustion engine and a variable displacement control system in accordance with the disclosed subject matter. In an embodiment, FIG. 3 illustrates an exemplary arrangement of an accelerator pedal sensor configured for use in combination with at least one engine control and/or monitoring system in addition to the control system 24.

As shown in FIG. 3 the engine 18 can include a plurality of combustion cylinder assemblies C1, C2, C3, C4, C5, C6 arranged in two banks of three assemblies each. However, exemplary embodiments are intended to include any appropriate number and arrangement of the assemblies. Each of the assemblies C1, C2, C3, C4, C5, C6 can be configured in any appropriate manner such as but not limited to the configuration of the combustion cylinder assembly C of FIG. 2.

An intake manifold 68 can be in selective fluid communication with each of the cylinders C1, C2, C3, C4, C5, C6. An intake conduit 70 can be in fluid communication with the ambient air outside of the vehicle 10. A throttle assembly 72 can be connected between the intake manifold 68 and the intake conduit 70. An air sensor 78, extending into the intake conduit 70, can be configured to output data indicative of the mass flow rate and the temperature of the air passing through the intake conduit 70.

The throttle assembly 72 can include a movable throttle valve 74 and a throttle position sensor 76. The throttle valve 74 can be movably mounted to selectively open and close fluid communication between the intake conduit 70 and the intake manifold 68. The throttle position sensor 76 can be configured to output data indicative of the angular position of the throttle valve 74 that can be expressed as a percentage of the wide open throttle position (WOT). FIG. 3 shows the throttle valve 74 in the wide open throttle position.

Figure 4:
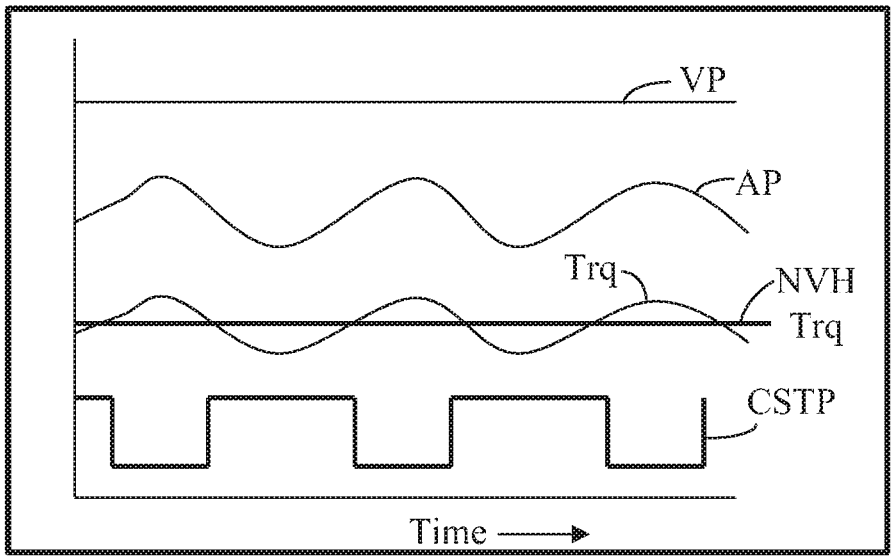
FIG. 4 is a graph of an exemplary driving cycle that can cause a variable cylinder management hunting risk in accordance with the disclosed subject matter.

The control system 24 can include one or more of the throttle position sensor 76, a longitudinal acceleration sensor 84, engine speed sensor 66, a vehicle speed (VP) sensor 80, and a next gear ratio input 82. The longitudinal acceleration sensor 84 can be a dedicated sensor input that can measure acceleration/deceleration of the vehicle 10. Embodiments are intended to include the omission of the longitudinal acceleration sensor 84, and the derivation of acceleration/deceleration from either the vehicle speed sensor 80 or from one or any combination of the wheel speed sensors 34LF, 34RF, 34LR, 34RR. The engine speed (Ne) sensor 66 can be mounted to the crankshaft 64 and can measure the rotational speed of the crankshaft 64. The vehicle speed sensor 80 can detect a vehicle speed based on information from sensors mounted on the transmission 20 to measure driveshaft rotational speed, or alternatively in the embodiments the controller 26 can calculate the vehicle speed using information received from wheel speed sensors 34LF, 34RF, 34LR, and 34RR. The next gear ratio input 82 can provide information regarding the current gear ratio selected in the transmission 20, and an upshift or downshift to a next target gear in the transmission FIG. 4 is a graph of an exemplary driving cycle that can cause variable cylinder management hunting risk in accordance with the disclosed subject matter. This exemplary plot illustrates various parameters of a vehicle traveling at a constant speed VP that can affect VCM hunting over time. The plot also illustrates that VCM hunting can also occur with torque request fluctuations while the vehicle travels at constant speed near the VCM torque limit. Plot VP can represent a driver operating a vehicle at constant VP. Plot AP can represent a driver actuating an accelerator pedal, where the peaks represent the driver depressing the accelerator pedal and the valleys represent the driving raising the accelerator pedal. The plot Trq can represent a driver-requested torque demand (Trq) over time, which can correlate AP. For example, as a driver depresses the accelerator pedal, Trq can correspondingly increase and as the driver raises the accelerator pedal, Trq can correspondingly decrease. Since VP remains constant, the plot can represent the fluctuation of Trq as the driver depresses or raises the accelerator pedal causing fluctuations in torque demand. Fluctuations in torque demand could be due one or more factors combined, such as but not limited to driving habit, road condition, road grade, vehicle load or towing, etc. The plot NVH Trq can represent a maximum threshold level for noise, vibration, and harshness (NVH) of an engine under VCM control. An NVH torque threshold can be based on various criteria relating to NVH effects. In some embodiments, a driver requested torque Trq above the NVH Trq threshold can trigger the VCM, and a driver requested torque Trq below the NVH threshold can trigger the VCM. Depending on VP and Ne, a large torque margin between torque demand and NVH Trq can result in a low VCM hunting risk, and a small torque margin between torque demand and NVH Trq can result in a high VCM hunting risk. The plot for cylinder stop (CSTP), or cylinder activation/deactivation, can represent a binary illustration of VCM control as either on (or true), where a VCM control system deactivates target cylinders (meaning that an engine operates with some form of cylinder deactivation as described above), or off (or false), where a control system activates target cylinders (meaning an engine operates with a greater number of cylinders than in deactivation mode). For example, the controller 26 can activate any deactivated cylinders when a driver requested torque Trq is received from the driver and the request rises above the threshold NVH Trq, and the controller 26 can deactivate target cylinders when the driver reduces the requested torque below the NVH threshold. The controller 26 fluctuation of VCM attempts to maintain the noise, vibration, and harshness criteria below the NVH threshold so that NVH noticed by the driver is minimized or eliminated regardless of the VCM operation.

II. VCM Controller Configuration

Figure 5:
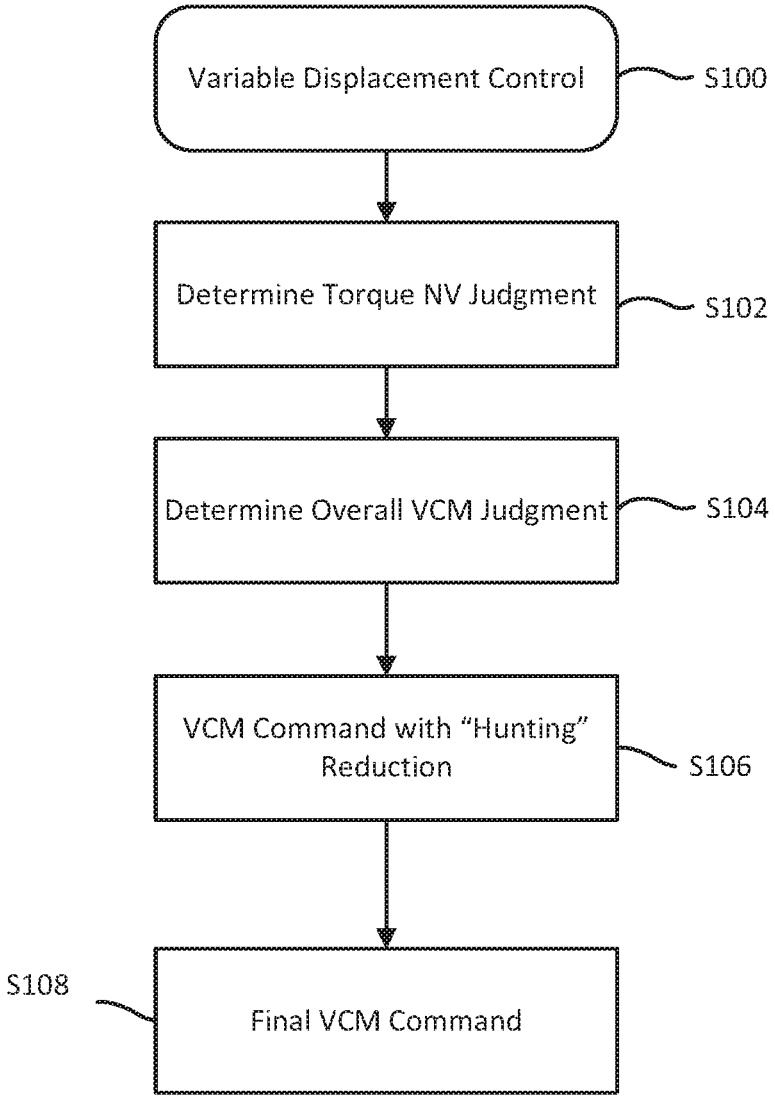
FIG. 5 is a flow chart of a configuration of a variable cylinder management control system in accordance with the disclosed subject matter.

FIG. 5 is a flow chart of a configuration of a variable cylinder management (VCM) control system in accordance with the disclosed subject matter. For example, a six-cylinder engine can be operated in a four-cylinder mode or in a three-cylinder mode. Similarly, an eight-cylinder engine can be operated in one of at least a six-cylinder mode and a four-cylinder mode. However, exemplary embodiments are intended to include or otherwise cover controlling VCM operations for engines with any number of individual combustion assemblies. The configuration can be implemented as an exemplary algorithm via executable instructions on a processor that the controller 26 can follow to determine if the controller 26 should selectively activate or deactivate one or more of the combustion assembles of the engine 18. The controller 26 can begin the algorithm at step S100. The controller 26 can then proceed to step S102.

At step S102, the controller 26 can analyze vehicle data and perform a torque NV judgment to determine whether the current torque request from the driver exceeds an NVH Trq threshold, as described above. The NVH Trq threshold can be predetermined based on known, estimated, or standardized criteria. The NVH Trq threshold can be set at any appropriate predetermined engine output torque that can provide the desired performance and/or perceived performance of the engine. During step S102 the controller 26 can set a respective parameter value that corresponds to a pass and a fail of the NV judgment. For example, the controller 26 can set an NV flag to a value of "1" if the current torque request from the driver is less than the NVH Trq threshold, and the controller 26 can set the NV flag to a value of "0" if the current torque request from the driver is greater than or equal to the NVH Trq threshold. The controller 26 can save the NV flag value in a memory device for later retrieval by the controller 26.

At step S104, the controller 26 can perform an overall VCM judgment to determine if cylinder deactivation should be initiated, continued or terminated. The controller 26 can retrieve the NV flag value determined at step S102. If the NV flag has a value of "0," then the controller 26 can set a VCM flag to a value of "0." Then the controller 26 can proceed to step S106. If during step S104 the controller 26 determines that the NV flag has a value of "1," then the controller 26 can check one or more operating parameters of the vehicle 10 and/or the engine 18 and/or the transmission 20 in order to determine whether cylinder deactivation (or re-activation) could result in an advantageous fuel consumption rate. Exemplary parameters can include but are not limited to engine speed, engine load, road grade, etc. If the controller 26 determines that each parameter has satisfied its predetermined criteria, the controller can set the VCM flag to a value of "1" so that cylinder deactivation can be initiated or continued. If the controller 26 determines that at least one parameter has not satisfied its predetermined criteria, the controller 26 can set the VCM flag to a value of "0" so that cylinder deactivation can be terminated or so that all combustion will continue in all of the cylinders C1-C6. The controller 26 can save the VCM flag value in a memory device for later retrieval by the controller 26.

In step S106, the controller 26 can set a value for a parameter, such as a CS flag, that indicates the number of cylinders that are to be deactivated by the cylinder deactivation assembly 28. As will be discussed in greater detail below, the subroutine of step S108 can permit the controller 26 to reduce the risk of "hunting" between cylinder deactivation and activation of all of the cylinders that can be caused by erratic or sudden changes in the position of the accelerator pedal (or the throttle valve 74). During the subroutine of step S108, the controller 26 can delay cylinder deactivation (or re-activation) by using either a predetermined fixed timer threshold or a variable timer threshold that can vary as a function of vehicle speed and the driver's torque request. This delay can reduce the risk of "hunting" between cylinder deactivation and re-activation. Before determining the appropriate timer threshold, the controller 26 can retrieve the VCM flag value determined at step S104. As will be discussed in further detail below, the controller 26 can determine the number of cylinders (0 or 2 or 3, for example, for a six-cylinder engine) that are to be deactivated. The controller 26 can save a CS flag to equal the number of cylinders to be deactivated. The controller 26 can save the CS flag value in a memory device for later retrieval by the controller 26.

At step S106, the controller 26 can issue a signal to the cylinder deactivation assembly 28 to deactivate the number of cylinder assemblies C1-C6 based on the value of the CS flag determined in step S104. For example, if the CS flag has a value of "0," then the controller 26 can signal the assembly 28 to activate all of the cylinder assemblies. Further, if the CS flag has a value of 3, then the controller 26 can signal the assembly 28 to deactivate the three cylinder assemblies C4-C6 of a common bank. At step S108, the controller 26 can issue a final VCM command that implements the VCM operation.

III. Control Based on Vehicle Speed and Torque Request

Figure 6:
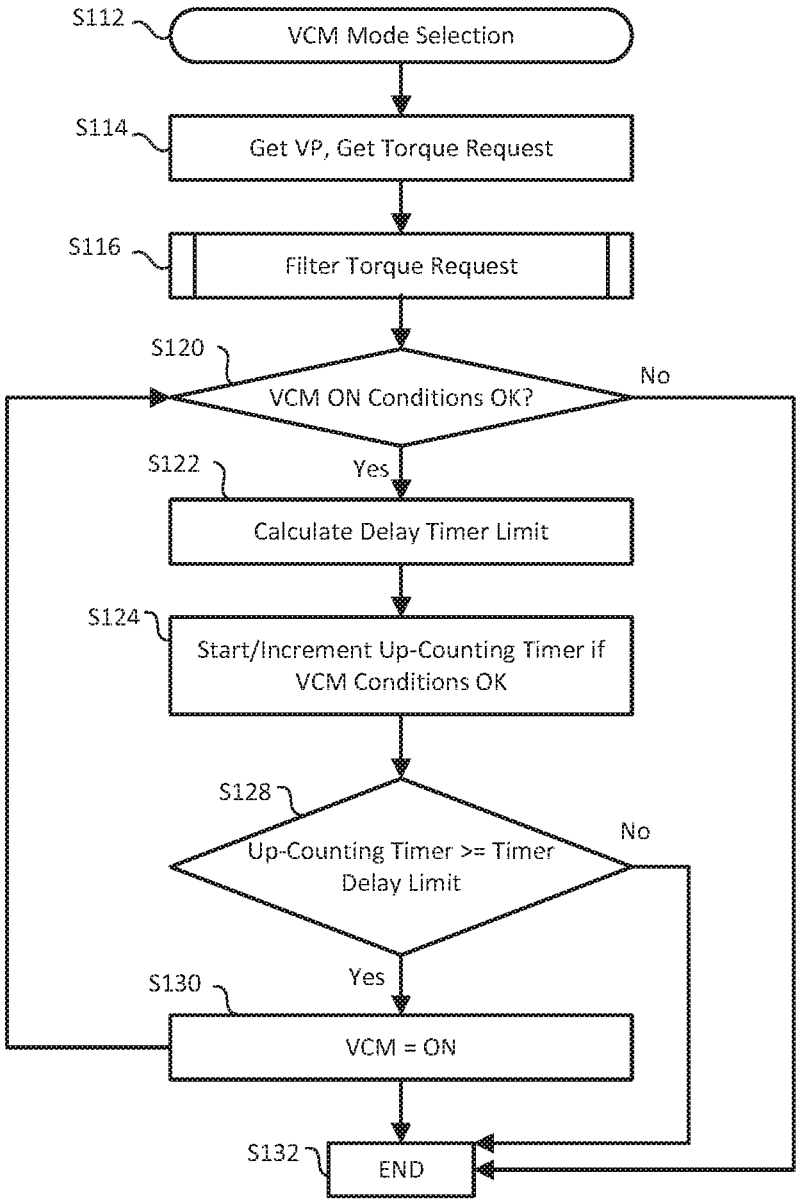
FIG. 6 is a flowchart of an exemplary algorithm for determining a risk of VCM hunting in accordance with the disclosed subject matter.

FIG. 6 is a flowchart of an exemplary algorithm that the controller 26 can follow to reduce or eliminate a risk of hunting between cylinder activation and deactivation in accordance with the disclosed subject matter. The exemplary algorithm is described in reference to controlling an engine with multiple combustion cylinder assemblies C1-C6. The exemplary algorithm can rely on vehicle speed and the driver's torque request. The vehicle speed VP can be represented by the speed data obtained from any one or any combination of the speed sensors 34LF, 34FR, 34LR, 34RR, 80.

In FIG. 6, the controller 26 can begin the algorithm at step S112 to initiate VCM mode selection. The controller 26 can then proceed to step S114.

At step S114, the controller 26 can receive vehicle speed VP data for the vehicle 10 and receive a torque request Trq from a driver via one or more of the accelerator pedal sensor 30 and the throttle position sensor 76. At step S116 the controller 26 can filter the torque request using various criteria. In one embodiment, the controller 26 can perform a torque filtering operation to provide an appropriate value to a lookup map. A comparison of driver torque and filtered torque is illustrated in FIG. 7.

Figure 7:
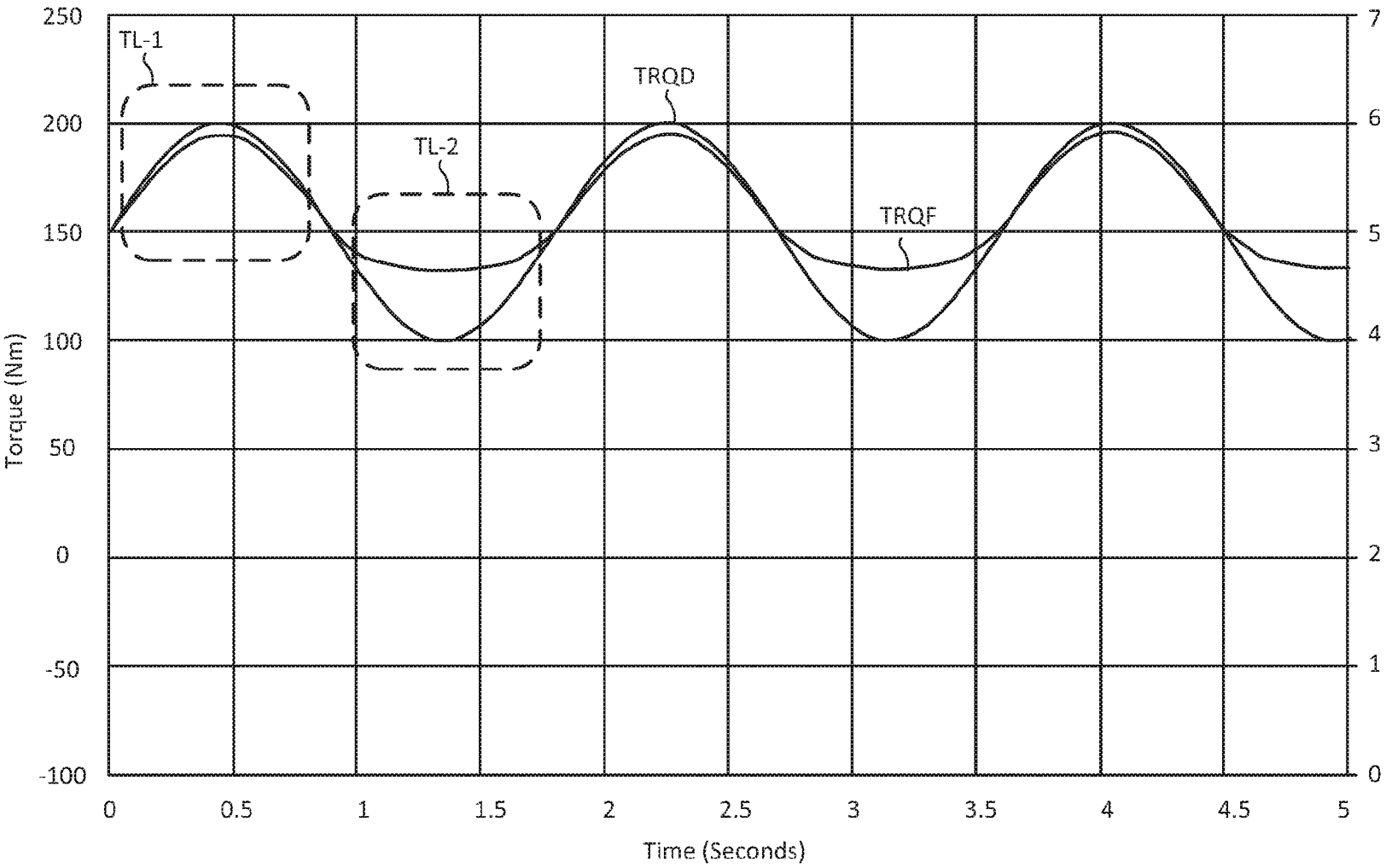
FIG. 7 is a graph of an exemplary timing plot of driver torque learning in accordance with the disclosed subject matter.

FIG. 7 is a graph of an exemplary timing plot of driver torque learning in accordance with the disclosed subject matter. The graph can represent plots of driver requested torque Trq over time together with a plot of filtered driver requested torque over the same time period. To filter requested torque, the controller 26 can weigh the torque request increase more than a decrease in order to prioritize a driver's demand for acceleration. In FIG. 7, the first requested torque in area TL-1 can represent an increase in torque demand. The controller 26 can execute fast high torque learning, where filtered torque closely follows the requested torque demand. The second requested torque in area TL-2 can represent a decrease in torque demand. In TL-2, the controller 26 can execute slow torque learning, where filtered torque diverges from the requested torque demand that results in a higher filtered torque value and lower torque demand fluctuation over time.

At step S120 in FIG. 6, the controller 26 can check certain VCM conditions that are appropriate for VCM operation. In one example, the current VCM operation should be detected before starting a new VCM operation. The controller 26 can determine if the engine 18 is currently in a VCM operation (i.e., operating with one or more cylinder assemblies C1-C6 deactivated) or not currently in a VCM operation (i.e., operating with no cylinder assemblies C1-C6 deactivated). In another instance, the controller 26 can determine if the transmission 20 is in the relevant gear ratio that is appropriate for a VCM operation. For example, the controller 26 can compare criteria for the current gear ratio selected in the transmission 20 to a next gear ratio appropriate for engaging VCM operations. The VCM logic may restrict the VCM operation to a top gear ratio, top two gear ratios, etc. However, the embodiments are intended to include or otherwise cover the VCM logic using any gear ratio that could provide advantageous fuel consumption rate. To check another VCM condition, the controller 26 can receive the current values of accelerator position from the accelerator pedal sensor 30 and/or throttle position from the throttle position sensor 76 and compare with a previous pedal/throttle position to determine if the relative displacement of the pedal or the throttle valve 74 exceeds a threshold displacement, which can indicate a torque request resulting from a driver's demand for acceleration. The controller 26 can obtain information from the accelerator pedal sensor 30. The data from the accelerator pedal sensor 30 can be indicative of movement of the throttle valve 74 sensed by throttle position sensor 76. Movement of the accelerator pedal or throttle valve 74 towards the fully opened position can correlate with a request for increased torque from a driver. Movement of the accelerator pedal or throttle valve 74 toward the fully closed position can correlate with a request for decreased torque from a driver. For example, if the controller 26 determines that the pedal displacement is less than a threshold, then the controller 26 can analyze the current VCM operation and determine if the engine 18 is operating with one or more cylinder assemblies C1-C6 deactivated. If the controller 26 determines the engine has one or more cylinders deactivated, then the controller can determine if the current vehicle conditions are appropriate for continuing the deactivation of the cylinders. This determination can rely on the values of the NV flag and the VCM flag set in steps S102 and S104.

As another condition in step S120, if the controller 26 determines the engine 18 does not have any of the cylinder assemblies C1-C6 deactivated, then the controller 26 can gather vehicle speed VP and acceleration data to determine if the vehicle 10 is decelerating. If the controller 26 detects deceleration of the vehicle 10, then the controller 26 can use a deceleration timer to determine if conditions are appropriate for cylinder deactivation.

At step 120, if the controller 26 determines that conditions are appropriate for VCM operation, then the controller 26 can analyze the current VCM state. If the controller 26 determines the engine 18 is currently operating in VCM, then the controller can reset the up-counting timer and continue VCM operation. If the controller 26 determines that the current state is not in VCM operation (that is, VCM is disengaged), then the controller 26 can compare criteria for the current gear ratio selected in the transmission 20 to a next gear ratio appropriate for engaging VCM. For example, VCM logic may restrict VCM operation to a top gear ratio, top two gear ratios, etc. However, the embodiments are intended to include or otherwise cover any gear ratio that could provide advantageous fuel consumption rate if the engine 18 operates in VCM. If the controller 26 in step S148 determines that the next gear ratio is not appropriate for VCM operation, then the controller 26 can proceed to step S150 and select a fixed timer threshold as a delay timer limit in step S122. If the controller 26 determines the next gear ratio is appropriate for VCM operation, then in step S152 the controller 26 can select a variable timer threshold as the delay timer limit. In an embodiment, the variable timer threshold can be determined as a function of the filtered torque criteria. In the algorithm, if the engine 18 is operating with VCM disengaged, the transmission 20 is in the relevant gear, and torque conditions are present that are appropriate for VCM operation, the controller 26 can determine a delay timer limit based on the filtered torque value and the current VP. The delay timer limit is used to postpone VCM activation based on a predicted VCM hunting risk.

If the controller 26 determines, in step S120, the current conditions are not appropriate to continue with cylinder deactivation, then the controller 26 can set the value of the CS flag to be "0." The controller 26 can reset an up-counting timer prior to ending the process at step S132.

At step S124, the controller 26 can initiate the up-counting timer while the conditions remain appropriate for VCM operation. Whether the controller 26 selects the fixed timer threshold or the variable timer threshold, at step S128 the controller 26 can compare the up-counting timer to the selected delay timer limit. While conditions are such that VCM is appropriate to operate, the variable timer limit can be continuously calculated by the controller 26 and compared to the up-counting timer. At step S128, if the controller 26 determines that the delay timer limit is greater than the up-counting timer value, then the controller 26 can proceed to the end of process step S132. However, if the controller 26 determines that the up-counting timer has a value greater or equal to the timer delay limit, then the controller 26 can engage VCM operation in the engine 18. After VCM engagement, the controller 26 can end the process at step S132.

IV. Driving Cycle

Figure 8:
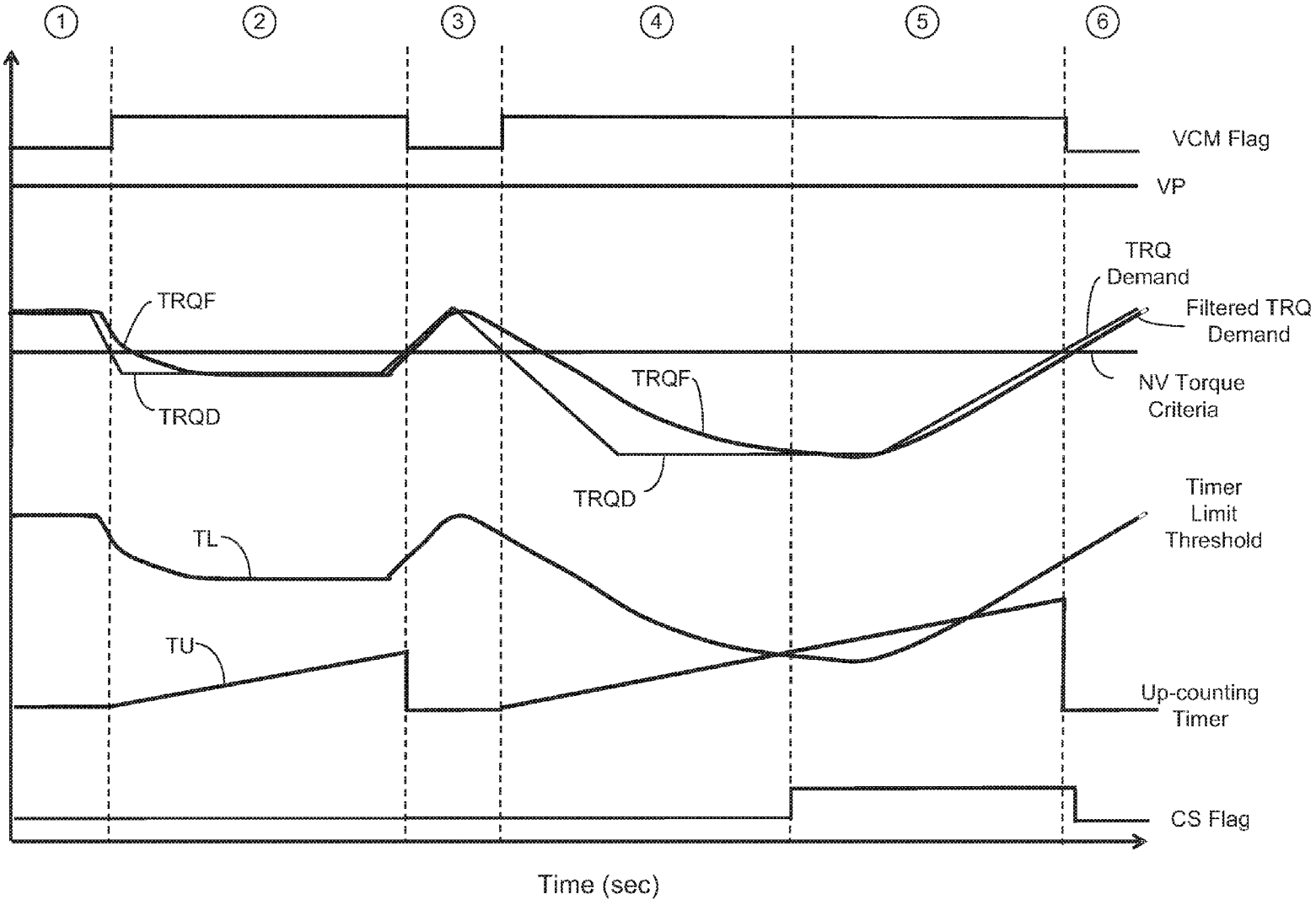
FIG. 8 illustrates an exemplary driving cycle in which a vehicle is operated in at least one fluctuating torque condition.

FIG. 8 illustrates an exemplary driving cycle where the vehicle 10 is operated in at least one fluctuating torque condition over time. FIG. 8 includes a graph showing a plurality of timing plots of exemplary vehicle operations and VCM criteria usable with the algorithm of FIG. 6 in order to advantageously maintain requested torque Trq as near to NV torque threshold as possible. Region 1 can represent the vehicle 10 traveling at a constant speed VP with no acceleration indicated by the constant torque demand TRQD (and consequently constant filtered torque demand TRQF). In FIG. 8, since VP is constant, and filtered torque and VP are the inputs to calculate timer limit TL, the TL data generally plots parallel with the TRQF plot. In Region 1, the TL threshold is separated by range above the TU, and therefore VCM will not engage. Based on this, the binary CS flag remains at a zero, or false, state.

Region 2 of FIG. 8 can depict a change in driving conditions that can begin when the torque demand TD on vehicle 10 decreases, which is closely tracked by the filtered torque TF. The controller 26 can determine that vehicle conditions are appropriate for VCM operation and can change the VCM flag from zero to one, or true. In Region 2, the conditions are available at FL such that controller 26 can activate the up-counting timer TU, which steadily rises in a predetermined count over the time period. The controller 26 can compare the variable timer limit threshold TL to the value of the up-counting timer TU over the same time period. In Region 2, the values for TU are less than the threshold timer limit values for TL and therefore the controller 26 will not command VCM to operate.

Region 3 can represent a vehicle condition in which the vehicle speed VP remains constant but the filtered torque demand TRQF rises to a sharp peak and then gradually decreases. The controller 26 can set the VCM condition flag FL from one to zero, indicating that regardless of the timer limits TL, conditions are not appropriate for VCM operation. In an embodiment, conditions in Region 3 are not advantageous for VCM because the filtered torque TRQF value increases above the NV torque threshold. The controller 26 can also reset the up-counting time TU to zero at the corresponding time of FL change.

Region 4 can represent a state where VCM operation would be appropriate under the current conditions. Vehicle speed VP remains constant but the filtered torque TRQF continues to gradually decrease but remains at a higher torque than TRQD. Over the same time period, the actual torque demand TRQD decreases in a sharp decline and abruptly flattens. The controller 26 changes VCM flag condition FL to true, meaning conditions are appropriate for VCM operation due to TF falling below the NV torque criteria threshold. In Region 4, the timer limit threshold TL gradually decreases from a trend that initiated in Region 3. The up-counting timer TU steadily increases across Region 4 until it crosses the TL threshold. According to the algorithm step S154, if TU is greater than or equal to TL, the controller 26 will command VCM operation. Since FL is true and VCM is available, and TU is greater than TL, which occurs at the TL crossing point, the controller 26 can command VCM operation. Using VCM also changes the binary plot for cylinder deactivation command, plotted as CS Flag, from zero, or false, to one, or true. This can occur when the controller 26 deactivates one or more target cylinders within the engine 18.

Region 5 can represent a condition of continuing VCM operation even as the filtered torque TRQF decline reverses a downward trend and begins a gradual increase. The TRQF increase causes the timer limit TL to correspondingly increase until it rises above the up-counting timer TU. In Region 5, although the TL threshold rises above up-counting timer TU, FL remains in a condition available for VCM and therefore the controller 26 does not cancel the VCM operation. Thus, the CS Flag plot remains in a true state during the time period of Region 5.

Region 6 can represent a continuation of the increasing filtered torque demand TRQF from Region 5 that crosses the NV torque criteria threshold at the start of Region 6. After TRQF crosses NV threshold, the controller 26 can disengage VCM due to the increased demand for torque beyond the ability for a reduced cylinder operation in the engine 18 to deliver. The controller 26 can change the VCM condition flag FL from one to zero, indicating that conditions are not appropriate for VCM due to the increased demand for torque greater than the NV torque criteria threshold.

The controller 26 can be configured with hardware, with or without software, to perform the operations discussed above. Electrical communication lines (not numbered) can connect the controller 26 to the engine 18, the transmission 20, the cylinder deactivation assembly 28, the sensors or inputs 30, 34LF, 34RF, 34LR, 34RR, 66, 76, 78 and the timer 32, in any appropriate manner. Electrical communication can be either one-way communication or two-way communication and can be networked or not networked. The controller 26 also can be referred to as an electronic control unit (ECU) or as a central processing unit. The sensors or inputs 30, 34LF, 34RF, 34LR, 34RR, 66, 76, 78 can be configured with hardware, with or without software, to perform the assigned task(s).

Any of the sensors or inputs 30, 34LF, 34RF, 34LR, 34RR, 66, 76, 78 can be configured as a smart sensor such that the sensor can process the raw data collected by the sensor prior to transmission to the controller 26 or the sensor can be configured as a simple sensor that passes the raw data directly to the controller 26 without any manipulation of the raw data. Any of the sensors or inputs 30, 34LF, 34RF, 34LR, 34RR, 66, 76, 78 can be configured to send data to the controller 26, with or without a prompt from the controller 26.

The wheel speed sensors 34LF, 34RF, 34LR, 34RR can be mounted on an appropriate portion of the vehicle 10 to detect rotation of the respective wheel 14L, 14R, 16L, 16R (or the respective driveshaft 22L, 22R) in any appropriate manner. The raw data from the wheel speed sensors 34LF, 34RF, 34LR, 34RR can be processed by one or both of the wheel speed sensors 34LF, 34RF, 34LR, 34RR or by the controller 26 to indicate a rotational velocity of the respective wheels 14L, 14R, 16L, 16R. The wheel speed sensors 34LF, 34RF, 34LR, 34RR can be any type of sensor capable of providing the appropriate data.

Exemplary embodiments are intended to include the timer 32 integrated into the controller 26. Exemplary embodiments are intended to include the controller 26 configured with hardware, with or without software, to perform the function provided by the timer 32 of the exemplary embodiment described above.

V. Alternative Embodiments

While certain embodiments of the invention are described above, and FIGS. 1-9 disclose the best mode for practicing the various inventive aspects, it should be understood that the invention can be embodied and configured in many different ways without departing from the spirit and scope of the invention.

Embodiments are disclosed above in the context of automotive vehicles. However, embodiments are intended to be applicable to any type of vehicle, including boats, ships, aircraft, etc.

Embodiments disclosed above disclose the fuel injector 58 arranged in a direct-injection configuration. However, embodiments are intended to include any fuel supply configuration such as but not limited to a port fuel-injection configuration, a single fuel injector that can supply each of the cylinder assemblies, a plurality of fuel injectors associated with each cylinder assembly, at least one carburetor, etc.

The disclosed controllers and other apparatus can include processors and computer programs implemented by processors used to perform various of the operations and determinations disclosed above. Exemplary embodiments are intended to cover all software or computer programs capable of enabling processors to implement the above operations and determinations. Exemplary embodiments are also intended to cover any and all currently known, related art or later developed non-transitory recording or storage mediums (such as a CD-ROM, DVD-ROM, hard drive, RAM, ROM, floppy disc, magnetic tape cassette, etc.) that record or store such software or computer programs. Exemplary embodiments are further intended to cover such software, computer programs, systems and/or processes provided through any other currently known, related art, or later developed medium (such as non-transitory mediums, carrier waves, etc.), usable for implementing the exemplary operations disclosed above.

These computer programs can be executed in many exemplary ways, such as an application that is resident in the memory of a device or as a hosted application that is being executed on a server and communicating with the device application or browser via a number of standard protocols, such as TCP/IP, HTTP, XML, SOAP, REST, JSON and other sufficient protocols. The disclosed computer programs can be written in exemplary programming languages that execute from memory on the device or from a hosted server, such as BASIC, COBOL, C, C++, Java, Pascal, or scripting languages such as JavaScript, Python, Ruby, PHP, Perl or other sufficient programming languages.

Some of the disclosed embodiments include or otherwise involve data transfer over a network, such as communicating various inputs over the network. The network may include, for example, one or more of the Internet, Wide Area Networks (WANs), Local Area Networks (LANs), analog or digital wired and wireless telephone networks (e.g., a PSTN, Integrated Services Digital Network (ISDN), a cellular network, and Digital Subscriber Line (xDSL)), radio, television, cable, satellite, and/or any other delivery or tunneling mechanism for carrying data. Network may include multiple networks or subnetworks, each of which may include, for example, a wired or wireless data pathway. The network may include a circuit-switched voice network, a packet-switched data network, a dedicated short range communication (DSRC) network, wireless access in vehicular environments (WAVE), or any other network able to carry electronic communications. For example, the network may include networks based on the Internet protocol (IP) or asynchronous transfer mode (ATM), and may support voice using, for example, VoIP, Voice-over-ATM, or other comparable protocols used for voice data communications. In one implementation, the network includes a cellular telephone network configured to enable exchange of text or SMS messages.

Examples of a network include, but are not limited to, a personal area network (PAN), a storage area network (SAN), a home area network (HAN), a campus area network (CAN), a local area network (LAN), a wide area network (WAN), a metropolitan area network (MAN), a virtual private network (VPN), an enterprise private network (EPN), Internet, a global area network (GAN), and so forth.

While the subject matter has been described in detail with reference to exemplary embodiments thereof, it will be apparent to one skilled in the art that various changes can be made, and equivalents employed, without departing from the scope of the invention. All related art references discussed in the above Description of the Related Art section are hereby incorporated by reference in their entirety.

What is claimed is:

1. A variable displacement controller for use with a vehicle engine that includes multiple cylinder assemblies, the controller including a processor for performing various operations, comprising:

receiving data indicative of a requested torque;

receiving data indicative of vehicle speed;

determining a torque variable timer threshold value based on the received data indicative of requested torque and vehicle speed;

initiating a timer; and comparing the timer value to the determined variable timer threshold value; and selectively activating/deactivating at least one of the engine cylinder assemblies based on the comparison between the timer value and the variable timer threshold value, such that the at least one of the engine cylinder assemblies is activated if the timer value is less than the variable timer threshold value, and the at least one of the engine cylinder assemblies is deactivated if the timer value is greater than or equal to the variable timer threshold value.

2. The variable displacement controller of claim 1, wherein the engine includes at least one of an intake actuator, exhaust actuator, spark plug, and fuel injector, and the processor selectively deactivates the at least one of the engine cylinder assemblies by sending a control signal to shut down at least one of the intake actuator, exhaust actuator, spark plug, and fuel injector to thereby prevent combustion within the at least one of the engine cylinder assemblies.

3. The variable displacement controller of claim 1, wherein the processor performs various operations further comprising:

filtering the requested torque by weighing a torque request increase more than a torque request decrease.

4. The variable displacement controller of claim 3, wherein the processor determines the engine torque value utilizing at least one electronically stored engine map that includes at least one parameter, the at least one parameter including any one of engine speed, throttle position as a percentage of wide open throttle, ignition timing, and exhaust gas recirculation mass.

5. The variable displacement controller of claim 1, wherein the processor performs further operations comprising:

determining one of throttle displacement and an accelerator pedal displacement; and comparing the throttle displacement or accelerator pedal displacement to a displacement threshold;

wherein the processor determines the variable timer threshold if the throttle displacement is greater than the displacement threshold.

6. The variable displacement controller of claim 1, wherein the processor performs further operations comprising:

receiving data indicative of a gear ratio selected in in a transmission;

comparing the gear ratio to a ratio threshold;

selecting a fixed predetermined timer threshold value if the gear ratio is less than the ratio threshold; and selectively activating/deactivating at least one of the engine cylinder assemblies based on the comparison between the timer value and the fixed predetermined timer threshold value, such that the at least one of the engine cylinder assemblies is activated if the timer value is less than the fixed predetermined timer threshold value, and the at least one of the engine cylinder assemblies is deactivated if the timer value is greater than or equal to the fixed predetermined timer threshold value, and if:

the at least one of the engine cylinder assemblies is deactivated, the timer value is less than the variable timer threshold, and the requested torque is less than the torque threshold value, then the at least one of the engine cylinder assemblies remains deactivated.

7. The variable displacement controller of claim 1, wherein the processor receives data indicative of engine speed from an engine speed sensor and from a throttle position sensor, and determines the engine torque value based on the data received from the engine speed sensor and from the throttle position sensor.

8. The variable displacement controller of claim 1, wherein the processor determines the torque limit using an electronically stored torque limit plot of engine speed versus ambient temperature.

9. The variable displacement controller of claim 1, wherein the processor receives data indicative of vehicle speed from a transmission speed sensor that is configured to output data indicative of the rotational speed of a vehicular transmission output shaft, and the processor determines the torque limit using at least one torque limit plot that is based on the data received from the transmission speed sensor.

10. The variable displacement controller of claim 1, whereon the processor performs further operations comprising:

comparing the requested torque to a torque threshold;

selectively activating/deactivating at least one of the engine cylinder assemblies based on the comparison between the timer value and the variable timer threshold value, and based on the comparison between the requested torque and the torque threshold, such that the at least one of the engine cylinder assemblies is activated if the timer value is less than the variable timer threshold value, and the at least one of the engine cylinder assemblies is deactivated if the timer value is greater than or equal to the variable timer threshold value.

11. A variable displacement system, comprising:

a vehicle engine including multiple cylinder assemblies;

a speed sensor that obtains data indicative of at least one of engine speed and vehicle speed; and a variable displacement controller that includes a processor for performing at least the following operations:

receiving data indicative of a requested torque;

receiving data indicative of vehicle speed;

determining a torque variable timer threshold value based on the received data indicative of requested torque and vehicle speed;

initiating a timer;

comparing the timer value to the determined variable timer threshold value; and selectively activating/deactivating at least one of the engine cylinder assemblies based on the comparison between the timer value and the variable timer threshold value, such that the at least one of the engine cylinder assemblies is activated if the timer value is less than the variable timer threshold value, and the at least one of the engine cylinder assemblies is deactivated if the timer value is greater than or equal to the variable timer threshold value.

12. The variable displacement system of claim 11, wherein the engine includes at least one of an intake actuator, exhaust actuator, spark plug, and fuel injector, and the processor selectively deactivates the at least one of the engine cylinder assemblies by sending a control signal to shut down at least one of the intake actuator, exhaust actuator, spark plug, and fuel injector to thereby prevent combustion within the at least one of the engine cylinder assemblies.

13. The variable displacement system of claim 12, wherein the processor determines the engine torque value utilizing at least one electronically stored engine map that includes at least one parameter, the at least one parameter including any one of engine speed, throttle position as a percentage of wide open throttle, ignition timing, and exhaust gas recirculation mass.

14. The variable displacement system of claim 11, wherein the processor performs various operations further comprising:

filtering the requested torque by weighing a torque request increase more than a torque request decrease.

15. The variable displacement system of claim 14, wherein the processor performs further operations comprising:

receiving data indicative of a gear ratio selected in in a transmission;

comparing the gear ratio to a ratio threshold;

selecting a fixed predetermined timer threshold value if the gear ratio is less than the ratio threshold; and selectively activating/deactivating at least one of the engine cylinder assemblies based on the comparison between the timer value and the fixed predetermined timer threshold value, such that the at least one of the engine cylinder assemblies is activated if the timer value is less than the fixed predetermined timer threshold value, and the at least one of the engine cylinder assemblies is deactivated if the timer value is greater than or equal to the fixed predetermined timer threshold value, and if:

the at least one of the engine cylinder assemblies is deactivated, the timer value is less than the variable timer threshold, and the requested torque is less than the torque threshold value, then the at least one of the engine cylinder assemblies remains deactivated.

16. The variable displacement system of claim 11, wherein the processor performs further operations comprising:

determining one of throttle displacement and an accelerator pedal displacement; and comparing the throttle displacement or accelerator pedal displacement to a displacement threshold;

wherein the processor determines the variable timer threshold if the throttle displacement is greater than the displacement threshold.

17. The variable displacement system of claim 11, wherein the processor receives data indicative of engine speed from an engine speed sensor and from a throttle position sensor, and determines the engine torque value based on the data received from the engine speed sensor and from the throttle position sensor.

18. The variable displacement system of claim 11, wherein the processor determines the torque limit using an electronically stored torque limit plot of engine speed versus ambient temperature.

19. The variable displacement system of claim 11, whereon the processor performs further operations comprising:

comparing the requested torque to a torque threshold;

selectively activating/deactivating at least one of the engine cylinder assemblies based on the comparison between the timer value and the variable timer threshold value, and based on the comparison between the requested torque and the torque threshold, such that the at least one of the engine cylinder assemblies is activated if the timer value is less than the variable timer threshold value, and the at least one of the engine cylinder assemblies is deactivated if the timer value is greater than or equal to the variable timer threshold value.

20. A method of performing variable displacement of a vehicle engine that includes multiple cylinder assemblies, the method comprising:

receiving data indicative of a requested torque;

receiving data indicative of vehicle speed;

determining a torque variable timer threshold value based on the received data indicative of requested torque and vehicle speed;

initiating a timer;

comparing the timer value to the determined variable timer threshold value; and selectively activating/deactivating at least one of the engine cylinder assemblies based on the comparison between the timer value and the variable timer threshold value, such that the at least one of the engine cylinder assemblies is activated if the timer value is less than the variable timer threshold value, and the at least one of the engine cylinder assemblies is deactivated if the timer value is greater than or equal to the variable timer threshold value.

* * * * *